United States Patent [19]

Stevenson

[11] 3,971,507

[45] July 27, 1976

[54] FOLDED MONEY PACK ENVELOPE

[75] Inventor: Mayne B. Stevenson, Park Ridge, Ill.

[73] Assignee: Arvey Corporation, Chicago, Ill.

[22] Filed: Oct. 20, 1975

[21] Appl. No.: 623,901

[52] U.S. Cl. ..... 229/72; 229/75; 229/80; 229/87 R

[51] Int. Cl.[2] ..... B65D 27/08

[58] Field of Search ..... 229/72, 68 R, 76, 80, 229/75, 87 R, 92.7; 206/39.7; 150/38, 39

[56] References Cited

UNITED STATES PATENTS

| | | | |
|---|---|---|---|
| 1,662,843 | 3/1928 | Backmyer | 229/72 |
| 3,043,493 | 7/1962 | Clegg | 229/72 |
| 3,528,602 | 9/1970 | Ritchie | 229/72 X |
| 3,531,046 | 9/1970 | Carrigan | 229/72 |
| 3,858,791 | 1/1975 | Gendron | 229/72 |
| 3,889,873 | 6/1975 | Clough | 229/75 X |

*Primary Examiner*—Stephen P. Garbe
*Attorney, Agent, or Firm*—Dessler, Goldsmith, Clement & Gordon, Ltd.

[57] ABSTRACT

A money pack envelope which is formed from a single piece of folded paper is disclosed herein. The sheet of flat paper has a pair of spaced parallel fold lines that divide the sheet into a central panel portion and first and second panel portions on respective sides of the central panel portion. The first and second panel portions are folded so that the first panel portion is located between the second panel portion and the central panel portion. The central and second panel portions have a common lateral edge at one end of the envelope while the adjacent lateral edge of the first panel portion defines a small acute included angle with the edges of the central and second panel portions. The first panel portion also has an inwardly offset portion at the opposite ends of the envelope to expose a portion of the central panel portion and the second panel portion has a tab folded along a fold line and the configuration of the tab is generally similar to the recess defined by the inwardly offset edge and the adjacent edge of the central panel portion.

8 Claims, 3 Drawing Figures

FOLDED MONEY PACK ENVELOPE

BACKGROUND OF THE INVENTION

The present invention relates generally to envelopes, and more specifically to envelopes of the type that are adapted to be used for transactions using banking machines.

The use of an envelope type carrier for transporting money between a cashier and a customer at locations such as drive-in windows has been in existence for years. These carriers generally include a sheet of paper that is folded to produce a carrier that is open at one side and along one end.

Quite recently, the banking industry has developed computerized automatic banking centers that may be positioned at remote locations and need not have an operator or a teller present for the customer to transact business.

Manufacturers of carriers for use in banks and particularly remote banking centers, are constantly striving for producing a simplified version of carrier for envelopes while still insuring that the envelope can be readily sealed sufficiently so that the contents does not get separated from the envelope.

SUMMARY OF THE INVENTION

According to the present invention, there is developed a very simple money pack envelope carrier that can be transported to the ultimate point of use and is sealed sufficiently to pass through automatic machines at remotely located banking centers. According to the present invention, a single flat sheet of paper can be converted into an envelope by utilizing only three fold lines strategically located in the flat sheet.

More specifically, the sheet that is adapted to be folded to produce an envelope is generally rectangular in plan view and has first and second spaced parallel fold lines which divide the sheet into a central panel portion and first and second panel portions on opposite sides of the central panel portion. One edge of the sheet which defines one end of the completed envelope has a flat planar lateral edge on the central portion as well as the second panel portion while the first panel portion has a flat lateral edge that defines a small included acute angle with respect to a plane extending through the first lateral edge of the central and second panel portions. This small acute angle will insure that the first panel portion will not extend on the lateral edges of the other panel portion after the envelope has been placed in the folded condition. This included angle is preferably less than 5° and is preferably on the order of approximately 1°.

The opposite lateral edge of the sheet which utilimately defines the opposite end of the envelope has an inwardly offset edge portion on the first panel portion and an extension on the same lateral edge of the second panel portion which extension is separated from the second panel portion by a fold line that defines an extension of the lateral edge of the central panel portion. The tab which is formed outside the fold line has a configuration that substantially corresponds to the configuration of the recess developed by the inwardly offset edge on the first panel portion so that the tab can be folded along the fold line and wll have a surface in engagement with an exposed portion of the central panel portion when the sheet is folded along the remaining fold lines. In this manner, the central and first panel portions can be folded upon each other and interconnected at one end of the ultimate envelope by an adhesive sealing means on the surface of either the central flat portion or the first flat portion. The second panel portion can then be folded along the second fold line so that the tab can be connected directly to the central panel portion to produce the envelope of the invention.

Preferably, the second panel portion has a recess in its outer lateral edge and also has a cut out at a corner remote from the tab to expose portions of the first panel portion to gain ready access to open the envelope at a subsequent time.

BRIEF DESCRIPTION OF SEVERAL VIEWS OF DRAWINGS

DETAILED DESCRIPTION

Figure 1:
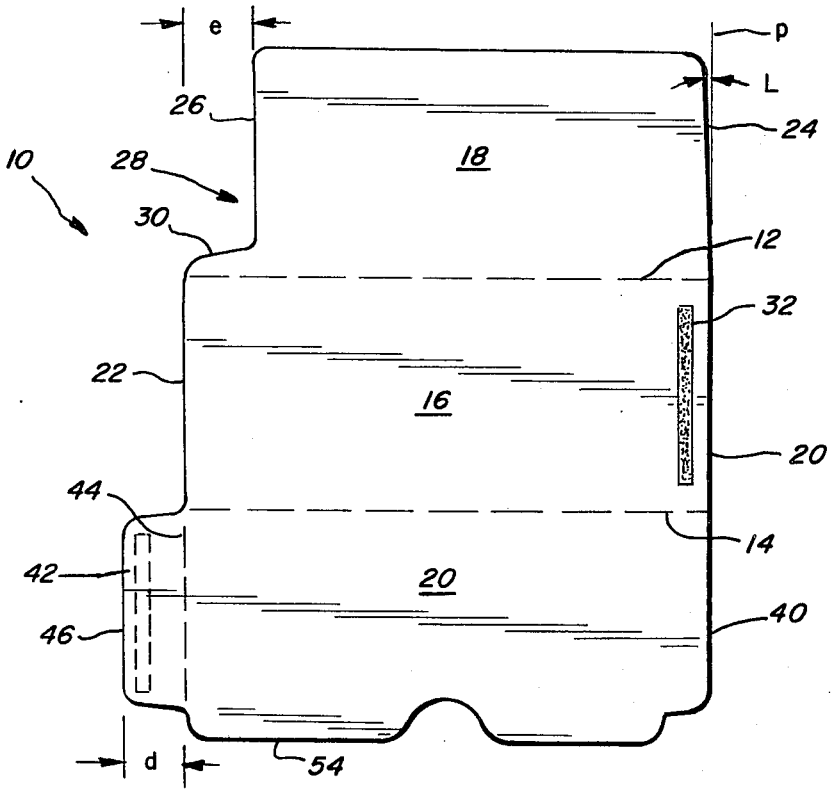
FIG. 1 is a plan view of a sheet in its flat configuration prior to the formation of an envelope.

While this invention is susceptible of embodiment in many different forms, there is shown in the drawing and will herein be described in detail preferred embodiments of the invention, with the understanding that the present disclosure is to be considered as an exemplification of the principles of the invention and is not intended to limit the invention to the embodiments illustrated. The scope of the invention will be pointed out in the appended claims.

Figure 3:
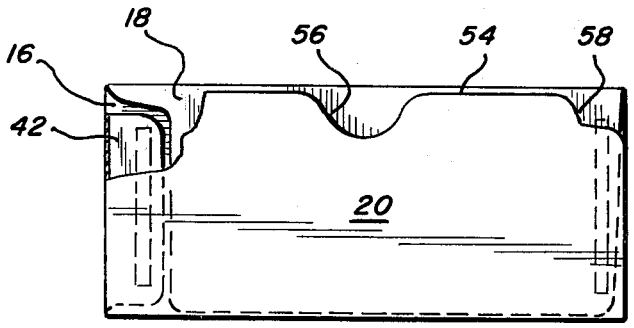
FIG. 3 shows the envelope in its fully closed condition, with sections thereof broken away for purposes of clarity.

FIG. 1 of the drawings generally discloses a flat sheet that has been transformed to produce the envelope shown in FIG. 3. Flat sheet 10 is generally rectangular in plan view and has first and second fold lines 12 and 14 which divide the sheet into a flat central panel portion 16, a first panel portion 18 located on the side of the central panel portion and a second panel portion 20 located on the opposite side of the central panel portion.

Central panel portion 16 has opposite ends which define first and second flat planar edges 20 and 22 that extend generally parallel to each other. The first planar flat portion 18 also has a flat lateral edge that defines an extension of first flat planar edge 20. According to the instant invention, flat lateral edge 24 is angularly related to flat lateral edge 20 when the sheet is in its unfolded condition as illustrated in FIG. 1. Stated another way, lateral edge 24 of first panel portion 18 defines a small included angle L with respect to a plane P and this included angle L is at least 1° and desirably is less than 5°, for a purpose that will be described later.

A first panel portion 18 also has a second flat lateral edge 26 that is inwardly offset and extends generally parallel to edge 22 on central panel portion 16 to produce a recess 28 at one corner of sheet 10. Flat planar edges 22 and 26 are preferably interconnected by an arcuate portion 30 that forms part of the first panel portion 18.

Also, the central panel portion has an elongated line of adhesive or connecting means 32.

Figure 2:
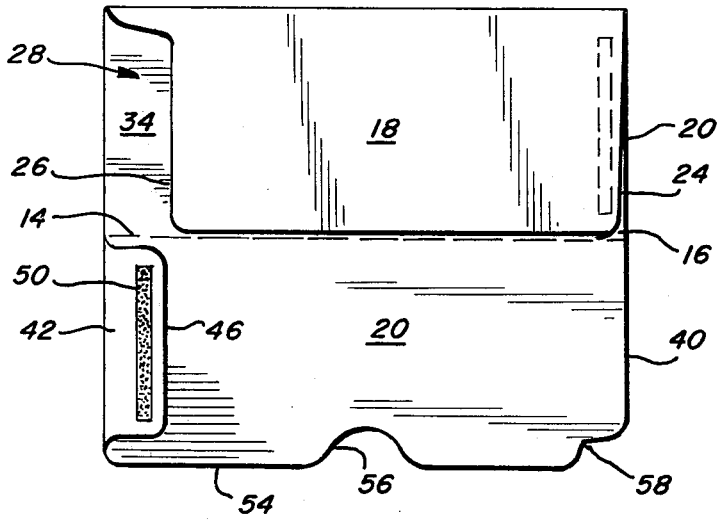
FIG. 2 shows the envelope in a partially folded condition.

Thus, when sheet 10 is folded along first fold line 12, a first surface of sheet 10 will have its first surface portions of central panel portion 16 and first panel portion 18 in contiguous contacting engagement with each other and the two panel portions can be interconnected utilizing the elongated line of adhesive 32. This condition is shown in FIG. 2 wherein it will be noted that recess 28 in first panel portion 18 exposes a portion 34 of central panel portion 16. This exposed portion 34 performs the function of allowing the second panel portion 20 to be attached to first panel portion 18 as will be discussed hereafter.

As viewed in FIG. 2, it will be noted that the central panel portion 16 and first panel portion 18 which define a double thickness and these panel portions are closed along two perpendicular edges and are open along the other two edges. It will also be noted that in the first or partially folded condition shown in FIG. 2, lateral edge 24 of first panel portion 18 is located inwardly of lateral edge 20 of central panel portion 16. This insures that this lateral edge will not extend beyond the periphery of the finished envelope and create a problem in a transfer of the envelope in automatic machines.

The remainder of sheet 10, consisting of second panel portion 20 again has a first lateral edge 40 that is located in the same plane with lateral edge 20 and defines an extension thereof. The opposite end of second central panel portion 20 has an extension 42 which is defined by a fold line 44 that extends parallel to and is a continuation of second lateral edge 22 of central panel portion 16.

As shown in FIG. 2, extension or tab 42 has an outer lateral edge 46 extending generally parallel to fold line 44 and the space in between fold line 44 and outer edge 46 has a dimension *d.* Also, in FIG. 1, the spacing of lateral edge 26 of central panel portion 18 and lateral edge 22 of central panel portion 16 is identified by the dimension *e.* According to the present invention, the dimension *d* is less than the dimension *e* so that when tab 42 is folded from the position illustrated in FIG. 1 to the position illustrated in FIG. 2, lateral edge 46 will be located outside of lateral edge 26. Thus, when sheet 10 is folded along second fold line 14, the entire tab 42 will be in contiguous relation with the exposed surface portion 34 of the central panel portion 16. Thus, by positioning a proper interconnecting means or second line of adhesive 50 on the tab or the adjacent surface of exposed surface portion 34, the tab 42 and thus second panel portion 20 is connected directly to central panel portion 16 to produce a completely enclosed envelope that is sealed on all four sides. It will be noted in FIG. 3, that the configuration of tab 42 is substantially identical to the configuration of recess 28 and that the tab is located in a common plane with first panel portion 18.

The second panel portion has recesses defined therein which readily allow a person to grip the envelope at selected locations for opening and removing the contents. As clearly shown in FIGS. 1, 2 and 3, second panel portion 20 has a flat outer lateral edge 54 that extends parallel to fold lines 12 and 14 and is closely adjacent the edge of the envelope defined by fold line 12. This flat outer lateral edge 54 has a recess 56 defined intermediate opposite ends thereof so that a portion of first panel portion 18 is exposed to define a gripping area. To further simplify the opening process, second panel portion 20 also has a cut out 58 located at the intersection between outer flat lateral edge 54 and first edge 40 to expose a corner portion of central panel portion 18.

While the present invention is not in any way limited to a particular type of paper, it has been found that the particular configuration allows for the manufacturer to use a paper having a weight of 28 pounds and having a caliper thickness on the order of 5.5 to 7.0 mills.

Suitably the invention has been illustrated in an embodiment wherein a single panel array may be used to make a variety of geometic figures. It should be appreciated that variations in the size of panel members will permit additional shapes to be made within the scope and spirit of the invention. The foregoing description is intended to be illustrative of the invention and other variations in either the spirit and scope of the invention may be made.

I claim:

1. A sheet adapted to be folded to produce an envelope, said sheet being generally rectangular in plan view and having four lateral edges, said sheet having first and second spaced parallel fold lines dividing said sheet into a central panel portion and first and second panel portions on opposite sides of said central panel portion, said central panel portion having opposite ends defining first and second flat planar edges extending parallel to each other, said first panel portion having one flat edge defining an extension of said first flat planar edge and being inwardly angularly related thereto, between said flat planar edges, said one flat edge defining an included angle of a least 1° with respect to a plane extending along said first flat planar edge, said first panel portion having a second flat edge offset inwardly from said second flat planar edge of said central panel portion and extending generally parallel thereto, said second panel portion having a further fold line defining a continuation of said second flat planar edge to produce a tab, said tab having an outer lateral flat edge spaced from said further fold line by a dimension that is less than the spacing between the second flat edge of said first panel portion and the second flat edge of said central panel portion so that said tab can be folded along said further fold line, said sheet can be folded along said first fold line to place said first panel portion in overlapping relation with said central panel portion and subsequently along said second fold line to have said second panel portion in overlapping relation with said first panel portion while said tab is in overlapping relation with said central panel portion.

2. A sheet as defined in claim 1, in which said second panel portion has a flat lateral edge extending parallel to said first and second fold lines, said flat lateral edge on said second panel portion having a recess intermediate opposite ends to define a gripping area between said first and second panel portions.

3. A sheet as defined in claim 2, in which said second panel portion has a further flat lateral edge extending parallel to said further fold line, said further flat lateral edge being located in said plane.

4. A sheet as defined in claim 3, in which said second panel portion has a cut out at the intersection of said flat lateral edge and said further flat lateral edge to expose a corner portion of said first panel portion when said sheet is in a folded condition.

5. A sheet as defined in claim 1, in which one of said central and first panel portions has a first area of adhesive on a surface thereof adjacent said first flat planar edge and a contact surface of one of said tab and said central panel portion has a second area of adhesive adjacent said second flat lateral edge of said central panel portion.

6. An envelope formed from a single flat sheet having first and second opposed surfaces and first and second spaced parallel fold lines dividing said sheet into a central panel portion and first and second panel portions on respective sides of said central panel portion and folded so that a first surface portion of said first panel portion is contiguous with a first surface portion of said central panel portion and a second surface portion of said first panel portion is contiguous with a first surface portion of said second panel portion, said central panel portion and said second panel portion having a common first flat lateral edge located in a common plane at one end of said envelope and an adjacent flat lateral edge of said first panel portion being an extension of said common lateral edge and defining a small acute included angle with said common lateral edge, said included angle being between about 1° and less than about 5°, said first panel portion having a second lateral edge on an opposite end of said envelope, said second lateral edge being inwardly offset from an adjacent edge of said central panel portion to expose a portion of said central panel portion to said second panel portion, said second panel portion having a tab folded along a further fold line to locate said tab between said exposed portion of said central panel and an adjacent portion of said second panel portion, first connecting means interconnecting only said first and central panel portions adjacent said one end of said envelope, and second connecting means interconnecting only said tab and said exposed central panel portion at the opposite end of said envelope.

7. An envelope as defined in claim 6, in which said second panel portion has a flat lateral outer edge extending parallel to said first fold line, said flat lateral edge having a recess intermediate opposite ends to produce a gripping area.

8. An envelope as defined in claim 7, in which said second panel portion has a cut out at the intersection between said first flat lateral edge and said flat lateral outer edge to expose a corner portion of said first panel portion.

* * * * *